US005259201A

United States Patent [19]

Sakai et al.

[11] Patent Number: 5,259,201

[45] Date of Patent: Nov. 9, 1993

[54] ELECTRIC CONTROL APPARATUS FOR ICE MAKING MACHINE

[75] Inventors: Tadashi Sakai, Toyoake; Yukimasa Takeda, Nagoya, both of Japan

[73] Assignee: Hoshizaki Denki Kabushiki Kaisha, Toyoake, Japan

[21] Appl. No.: 839,563

[22] Filed: Feb. 24, 1992

[30] Foreign Application Priority Data

Feb. 22, 1991 [JP] Japan ..... 3-050552

[51] Int. Cl.[5] ..... F25C 1/12

[52] U.S. Cl. ..... 62/135; 62/233

[58] Field of Search ..... 62/233, 135, 347, 352

[56] References Cited

U.S. PATENT DOCUMENTS

| | | | |
|---|---|---|---|
| 3,299,656 | 1/1967 | Linstromberg et al. | 62/233 |
| 3,388,560 | 6/1968 | Moreland, II | 62/233 X |
| 3,449,919 | 6/1969 | Fox | 62/233 X |
| 3,541,806 | 11/1970 | Jacobs | 62/233 |
| 4,903,505 | 2/1990 | Sakai et al. | 62/347 |
| 4,934,159 | 6/1990 | Sakai et al. | 62/347 |
| 5,105,632 | 4/1992 | Naruse | 62/233 X |

*Primary Examiner*—William E. Tapolcai

*Attorney, Agent, or Firm*—Nikaido, Marmelstein, Murray & Oram

[57] ABSTRACT

In an ice making machine having an upright ice making plate 12 arranged above a water tank 11, refrigeration circuit for circulating refrigerant to an evaporator 13 attached to the ice making plate 12, a hot gas valve 18 disposed within a bypass line of the refrigeration circuit to be opened to supply a hot gas to the evaporator 13 at a defrost cycle, a water pump 25 arranged to supply the ice making water from the water tank 11 to an upper portion of the front surface 12*a* of the ice making plate 11 at an ice making cycle, and a water valve 23 arranged to supply a defrost water from an external source of water to an upper portion of the rear surface 12*b* of the ice making plate 12 at the defrost cycle, the electric control apparatus includes a thermal sensor 73 arranged to detect a temperature at the outlet portion of the evaporator 13, and is designed to start measurement of a predetermined time when the temperature detected by the sensor 73 rises to a predetermined temperature at the defrost cycle after the preceding ice making cycle and to close the hot gas valve 18 and the water valve 23 upon lapse of the predetermined time.

4 Claims, 6 Drawing Sheets

ELECTRIC CONTROL APPARATUS FOR ICE MAKING MACHINE

BACKGROUND OF THE INVENTION

1. Field of the Invention

The present invention relates to an electric control apparatus for an ice making machine wherein an upright ice making plate is provided at its rear surface with an evaporator to be supplied with compressed refrigerant during an ice making cycle for forming ice cubes on the front surface of the ice making plate, and wherein during a defrost cycle, the evaporator is supplied with hot gas and the ice making plate is supplied at its rear surface with fresh water from an external source of water to release the formed ice cubes therefrom and drop them into an ice stocker. More particularly, the present invention relates to an improvement of defrost cycle control means in the electric control apparatus for controling the defrost cycle of the ice making machine.

2. Description of the Prior Art

As is disclosed in Japanese Utility Model Publication No. 61-42058, a conventional defrost cycle control device is designed to turn on a hot gas valve for supply of hot gas to an evaporator and a water valve for supply of fresh water to the rear surface of an upright ice making plate on start of a defrost cycle and to turn off the hot gas and water valves to end the defrost cycle when a temperature detected by a thermal sensor at the outlet of the evaporator becomes higher than a predetermined temperature. In the defrost cycle control device, a timer is also provided to measure a predetermined time when the hot gas and water valves are turned on, thereby maintaining the defrost cycle during the predetermined time even if the detected temperature becomes higher than the predetermined temperature. This is useful to ensure the supply of fresh water to be used at the ice making cycle.

In the ice making machine of this kind, however, the ice making plate is made of stainless steel; the heat transfer coefficient of this material is relatively low, and it is difficult to equalize the heat transfer coefficient between the ice making plate and the evaporator coil because of a difference in soldering. On the other hand, the temperature detected by the thermal sensor is greatly influenced by an ambient temperature and a temperature of defrost water supplied through the water valve. In a condition where both the ambient temperature and the defrost water temperature are low, the temperature detected at the outlet of the evaporator saturates at the end of the defrost cycle, resulting in a significant difference between the detected temperature and presence of the ice cubes on the ice making plate. It is, therefore, difficult to accurately detect presence of ice cubes on the ice making plate. If the temperature for detecting the end of the defrost cycle was determined to be low, the defrost cycle of operation would be ended in spite of presence of the ice cubes to be released from the ice making plate. If the temperature for detecting the end of the defrost cycle was determined to be high, the defrost cycle of operation would not be ended in spite of no presence of the ice cubes to be released from the ice making plate.

SUMMARY OF THE INVENTION

It is, therefore, a primary object of the present invention to provide an electric apparatus for the ice making machine capable of determining an ending time of the defrost cycle as accurately as possible and of ensuring the supply of fresh water to be used at the following ice making cycle.

A secondary object of the present invention is to provide an electric control apparatus for the ice making machine capable of determining an ending time of the defrost cycle as accurately as possible irrespective of a difference in heat transfer coefficient between the ice making plate and the evaporator and changes of an ambient temperature and a defrost water temperature caused by change of the season.

A third object of the present invention is to provide an electric control apparatus for the ice making machine capable of completely releasing ice cubes from the ice making plate even in a condition where the ambient temperature and the defrost water temperature are extremely low.

A fourth object of the present invention is to provide an electric control apparatus for the ice making machine capable of completely releasing ice cubes from the ice making plate without unnecessary discharge of the defrost water from the water tank, even in a condition where the ambient temperature and the defrost water temperature are extremely low.

A fifth object of the present invention is to provide an electric control apparatus for the ice making machine capable of ensuring the supply of fresh water to be used at the following ice making cycle, even in a condition where the ambient temperature and the defrost water temperature are high.

According to the present invention, there is provided an electric control apparatus for an ice making machine having a water tank arranged to store an amount of ice making water, an upright ice making plate arranged above the water tank, an evaporator attached to a rear surface of the ice making plate, a refrigeration circuit for circulating refrigerant into the evaporator through a compressor, condenser and an expansion valve, a hot gas valve disposed within a bypass line of the refrigeration circuit to control the supply of hot gas from the compressor to the evaporator, a water pump arranged to supply the ice making water from the water tank to an upper portion of the front surface of the ice making plate, and a water valve arranged to control the supply of defrost water from an external source of water to an upper portion of the rear surface of the ice making plate, the electric control apparatus comprising means for activating the water pump for a predetermined time in a condition where the hot gas valve and the water valve are maintained in their closed positions thereby to form ice cubes on the front surface of the ice making plate during an ice making cycle, defrost control means for opening the hot gas valve and the water valve after the ice making cycle and maintaining them in their open positions for a predetermined time in a condition where the water pump is deactivated thereby to release the ice cubes from the ice making plate and drop them into an ice stocker during a defrost cycle, and means for alternately conducting the ice making cycle and the defrost cycle, wherein the defrost control means comprises a thermal sensor arranged to detect a temperature at the outlet of the evaporator, and first timer means for starting measurement of a first predetermined time when the temperature detected by the thermal sensor rises to a first predetermined temperature and for closing the hot gas valve and the water valve upon lapse of the first predetermined time.

In a preferred embodiment of the present invention, the defrost control means described above further comprises time setting means for selectively setting the first predetermined time which is measured by the first timer means.

In a further preferred embodiment of the present invention, the defrost control means described above further comprises timer initializing means for causing the first timer means to newly start measurement of the first predetermined time from a predetermined value when the temperature detected by the thermal sensor becomes lower than a second predetermined temperature which is lower than the first predetermined temperature during the first timer means is measuring the first predetermined time.

In a still further preferred embodiment of the present invention, the defrost control means described above further comprises a second timer means for starting measurement of a second predetermined time which is longer than the first predetermined time when the hot gas valve and the water valve are opened and for closing the water valve upon lapse of the second predetermined time.

In a still further preferred embodiment of the present invention, the defrost control means described above further comprises a second timer means for starting measurement of a second predetermined time which is longer than the first predetermined time when the hot gas valve and the water valve are opened and for prohibiting the first timer means from closing the hot gas valve and the water valve until lapse of the second predetermined time.

BRIEF DESCRIPTION OF THE DRAWINGS

Other objects, features and advantages of the present invention will be more readily appreciated from the following detailed description of a preferred embodiment thereof when taken together with the accompanying drawings, in which.

DESCRIPTION OF THE PREFERRED EMBODIMENT

Figure 1:
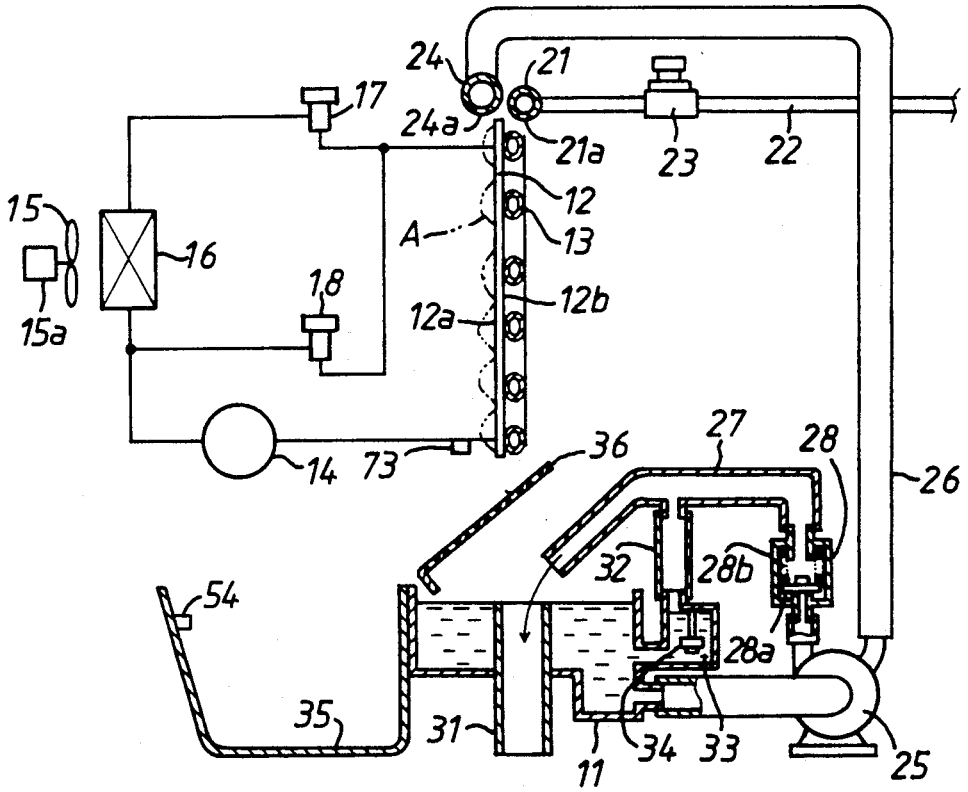
FIG. 1 is a schematic illustration of an ice making machine.

In FIG. 1 of the drawings, there is illustrated an ice making machine which is provided with a water tank 11 arranged to store an amount of ice making water and an upright lee making plate 12 of stainless sheet metal located above the water tank 11 to form ice cubes A on its front surface 12*a*. An evaporator coil 13 is soldered to a rear surface 12*b* of ice making plate 12 and connected at its inlet to an expansion valve 17 and at its outlet to a refrigerant compressor 14. In a refrigeration circuit of the ice making machine, the compressor 14 is connected at its outlet to a finned condenser 16 provided with a cooling fan 15 driven by an electric motor 15*a*, and the condenser 16 is connected at its outlet to the expansion valve 17. The compressor 14 is further connected at its outlet to the downstream of expansion valve 17 by way of a bypass line provided with an electrically operated hot gas valve 18 of the normally closed type. Arranged above the rear surface 12*b* of ice making plate 12 is a watering pipe 21 which is connected to a water service pipe 22 through an electrically operated water valve 23 of the normally closed type. When supplied with fresh water from the water service pipe 22 through the water valve 23, the watering pipe 21 renders the supplied water flow down from its sprinkler holes 21*a* along the rear surface 12*b* of ice making plate 12 as defrost water.

Arranged above the front surface 12*a* of ice making plate 12 is a watering pipe 24 which is connected to a water pump 25 through a water supply pipe 26. When supplied with ice making water from the water supply pipe 26 in operation of the water pump 25, the watering pipe 24 renders the supplied ice making water flow down from its sprinkler holes 24*a* along the front surface 12*a* of the ice making plate 12. The water pump 25 is driven by an electric reversible motor 25*a* to supply the ice making water into the water supply pipe 26 from the water tank 11 in its forward rotation and to supply the ice making water into a discharge pipe 27 from the water tank 11 in its reverse rotation. The discharge pipe 27 is provided with a pressure valve 28 which includes a valve body 28*a* loaded by a compression spring 28*b* downward to be normally closed. When applied with the water under pressure from the water pump 25, the valve body 28*a* is moved against the load of spring 28*b* to permit the flow of water into the discharge pipe 27. The outlet end of discharge pipe 27 is placed above an overflow pipe 31 disposed within the water tank 11 to discharge the ice making water through the overflow pipe 31.

The discharge pipe 27 is connected to a sub-tank 33 through a pipe 32 to render a portion of the supplied water flow into the sub-tank 33. The sub-tank 33 is communicated at its bottom portion with the water tank 11 and contains therein a float switch 34 which is arranged to be closed when the level of water in tank 11 becomes higher than a predetermined level and opened when the level of water in tank 11 becomes lower than the predetermined level. A perforated water plate 36 is tiltably arranged above the water tank 11 to permit the water flowing down therethrough into the water tank 11 from the ice making plate 12 and to receive ice cubes released from the ice making plate 12.

Figure 2:
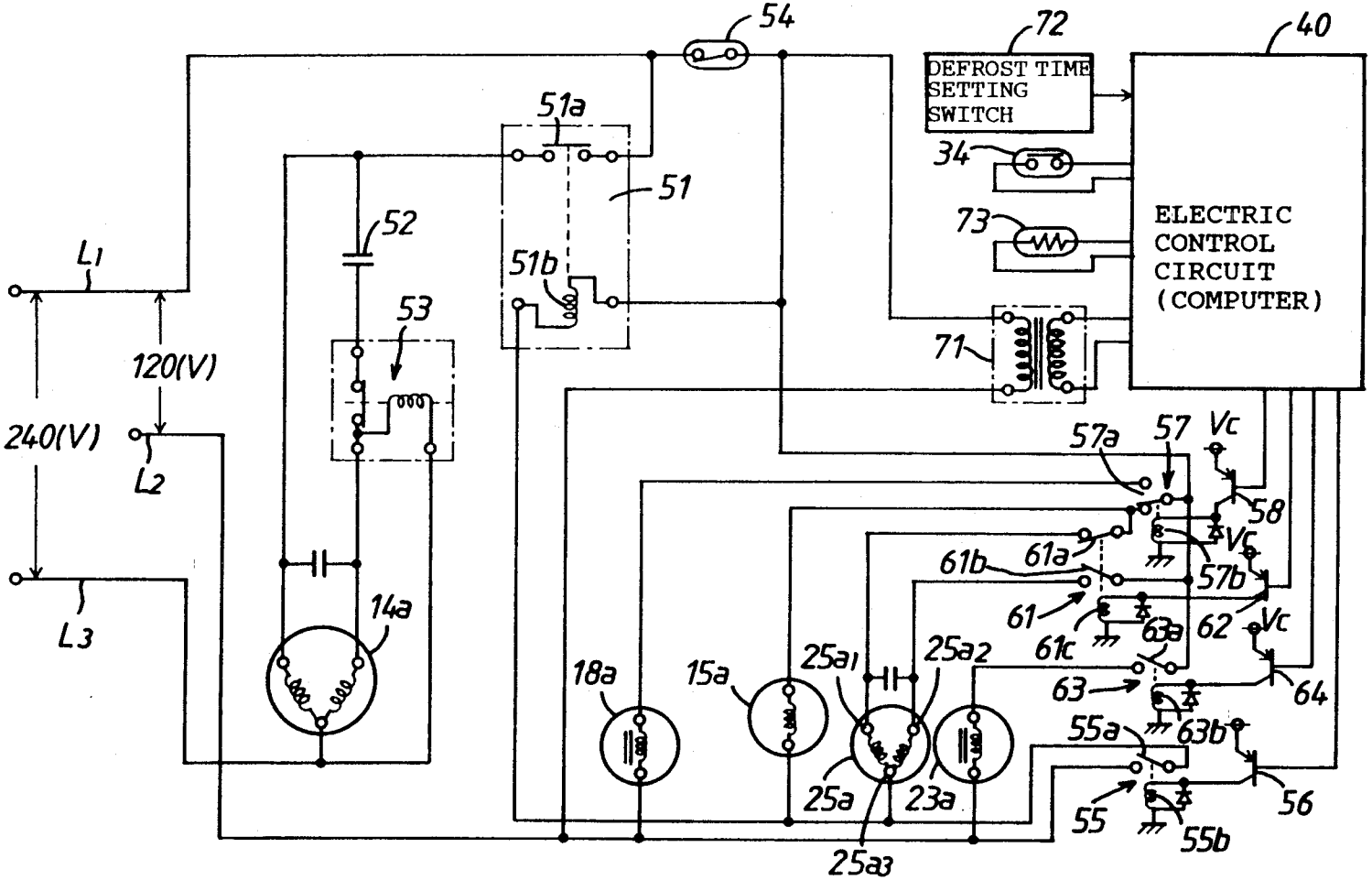
FIG. 2 is an electric control apparatus for the ice making machine in accordance with the present invention.

As shown in FIG. 2, an electric control apparatus for the ice making machine has three input buses L1, L2, L3 connected to an electric motor 14*a* of the refrigerant compressor 14, a solenoid 18*a* of hot gas valve 18, an electric motor 15*a* of cooling fan 15, an electric motor 25*a* of the water pump 25, a solenoid 23*a* of water valve 23 and a control circuit 40 for the electric motors and solenoids. The input buses L1, L2, L3 are connected to a commercially available power source of the single-phase three-wire type. In this embodiment, the input buses L1, L2 are arranged to be applied with a source voltage of 120 volt, while the input buses L1, L3 are arranged to be applied with a source voltage of 240 volt.

The electric motor 14*a* of the compressor 14 is connected at its one end to the input bus L1 through a normally open contact 51*a* of a relay switch 51 and at its other end to the input bus L3. Interposed between the normally open contact 51*a* and the electric motor 14*a* are a drive capacitor 52 and a start relay 53. The normally open contact 51*a* is associated with a relay coil 51*b* which is connected at its one end to the input bus L1 through a thermostat switch 54 and at its other end to the input bus L2 through a normally open contact 55*a* of a relay switch 55. When applied with the source voltage of 120 volt, the relay coil 51*b* is energized to close the normally open contact 51*a*. As shown in FIG. 1, the thermostat switch 54 is mounted on an inside upper portion of an ice stocker 35 to be opened at a predetermined temperature when the ice stocker 53 has been filled with ice cubes. The normally open contact 55*a* of relay switch 55 is associated with a relay coil 55*b* which is grounded at its one end and connected at its other end to the collector of a switching transistor 56. When the switching transistor 56 is turned on, the relay coil 55*b* is energized to close the normally open contact 55*a*.

The solenoid 18*a* of hot gas valve 18 and the motor 15*a* of cooling fan 15 are connected at their one ends to the input bus L1 through a movable contact 57*a* of a relay switch 57 and the thermostat switch 54. The solenoid 18*a* of hot gas valve 18 is connected at its other end to the input bus L2, while the motor 15*a* of cooling fan 15 is connected at its other end to the input bus L2 through the normally open contact 55*a* of relay switch 55. The movable contact 57*a* is retained in a first position during deenergization of the relay coil 57*b* to connect the motor 15*a* of cooling fan 15 to the input bus L1 through the thermostat switch 54 and is switched over in response to energization of the relay coil 57*b* from the first position to a second position to connect the solenoid 18*a* of hot gas valve 18 to the input bus L1 through the thermostat switch 54. The relay coil 57*b* is grounded at its one end and connected at its other end to the collector of a switching transistor 58 to be energized when the transistor 58 is turned on.

The electric motor 25*a* of water pump 25 has a first control terminal 25*a*1 for forward rotation connected to the input bus L1 through a normally closed contact 61*a* of a relay switch 61, the movable contact 57*a* of relay switch 57 and the thermostat switch 54, a second control terminal 25*a*2 for reverse rotation connected to the input bus L1 through a normally open contact 61*b* of relay switch 61 and the thermostat switch 54, and a common terminal 25*a*3 connected to the input bus L2 through the normally open contact 55*a* of relay switch 55. The relay switch 61 includes a relay coil 61*c* grounded at its one end and connected at its other end to the collector of a switching transistor 62. When the switching transistor 62 is turned on, the normally closed contact 61*a* is opened in response to energization of the relay coil 61*c*, while the normally open contact 61*b* is closed in response to energization of the relay coil 61*c*. The solenoid 23*a* of water valve 23 is connected at its one end to the input bus L1 through a normally open contact 63*a* of a relay switch 63 and the thermostat 54 and at its other end to the input bus L2. The relay switch 63 includes a relay coil 63*b* grounded at its one end and connected at its other end to the collector of a switching transistor 64. When the transistor 64 is turned on, the relay coil 63*b* is energized to close the normally open contact 63*a*.

The electric control circuit 40 is in the form of a microcomputer which is comprised of a CPU, a ROM, a RAM and a timer. The computer 40 is arranged to execute a main control program for control of switching transistors 56, 58, 62, 64 as shown by a flow chart in FIG. 3 and to execute a timer interruption program for counting up four count values IFCT, WFCT, FDCT, FICT shown by a flow chart in FIG. 6 when applied with an interruption signal from the timer at a predetermined time interval. The computer 40 is connected to a transformer 71, a defrost time setting switch 72, the float switch 34 and a thermal sensor 73.

The transformer 71 is interposed between input buses L1 and L2 through the thermostat switch 54 to activate the computer 40. The defrost time setting switch 72 is composed of a plurality of selection switches which are selectively operated to produce a signal representing a defrost time (for instance, 60, 90, 120, 180 seconds) for defrost. The thermal sensor 73 is provided on an outlet portion of evaporator coil 13 to produce a signal indicative of a temperature of refrigerant discharged from the evaporator coil 13.

Hereinafter, the operation of the electric control apparatus will be described in detail. Assuming that a power source switch (not shown) has been closed to apply an an electric power to the input buses L1, L2, the computer 40 is applied with the electric power through the transformer 71 to initiate execution of the main program at step 100 shown in FIG. 3. In a condition where the ice stocker 35 is filled with lee cubes, the thermostat switch 54 is in its open position to prohibit the supply of electric power to the computer 40. When the program proceeds to step 102 for initial setting, the computer 40 sets an initial flag IFLG indicative of an initial state of program execution as "0". At step 102, the computer 40 further initializes various variables for execution of the main control program.

When the program proceeds to step 104 for an initial water supply cycle, the switching transistor 64 is turned on, and the solenoid 23*a* of water valve 23 is energized under control of the relay switch 63. Thus, the water valve 23 is opened to permit the supply of fresh water into the watering pipe 21 from the water service pipe 22. In turn, the fresh water flows into the water tank 11 from watering pipe 21 along the rear surface 12*b* of ice making plate 12. The initial water supply cycle is repeated under control of a timer for a predetermined time (for instance, 1 minute). Upon lapse of the predetermined time, the program proceeds to step 106 where the computer 40 determines whether the float switch 34 is closed or not. When the level of water in tank 11 is still below the predetermined level, the float switch 34 is maintained in its open position. In such a condition, the computer 40 determines a "NO" answer at step 106 to repeat the initial water supply cycle.

When the level of water in tank 11 reaches the predetermined level to close the float switch 34, the computer 40 determines a "YES" answer at step 106 and causes the program to proceed to step 108. At step 108, the computer 40 causes the switching transistor 56 to turn on for energizing the relay coil 55*b*. Thus, the normally open contact 55*a* of relay switch 55 is closed in response to energization of the relay coil 55*b*, and in turn, the relay coil 51*b* is energized to close the normally open contact 51*a* of relay switch 51. As a result, the electric motor 14*a* is activated to start the refrigerant compressor 14 for circulating the refrigerant through the condenser 16, expansion valve 17 and evaporator coil 13 in the refrigeration circuit. Thereafter, the computer 40 executes a defrost cycle control routine, an ice making cycle control routine and a drain cycle control routine, respectively at step 110, 114 and 116, as will be described later.

Figure 6:
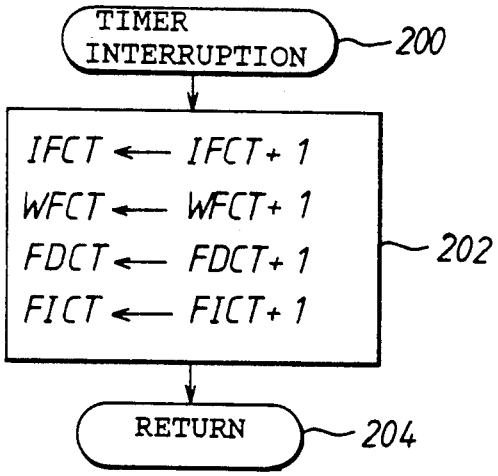
FIG. 6 is a flow chart of an interruption program executed by the microcomputer.

When applied with an interrupt signal from the timer during execution of the main control program, the computer 40 initiates execution of the interruption program at step 200 shown in FIG. 6. At step 202 of the interruption program, the computer 40 counts up a first count value IFCT for ensuring the end of defrost cycle, a second count value WFCT for detecting an ending time of the water supply cycle, a third count value FDCT for detecting an ending time of the defrost cycle and a fourth count value FICT for prohibiting the end of the water supply cycle, respectively with "1". At step 204, the computer 40 finishes execution of the interruption program.

Figure 3:
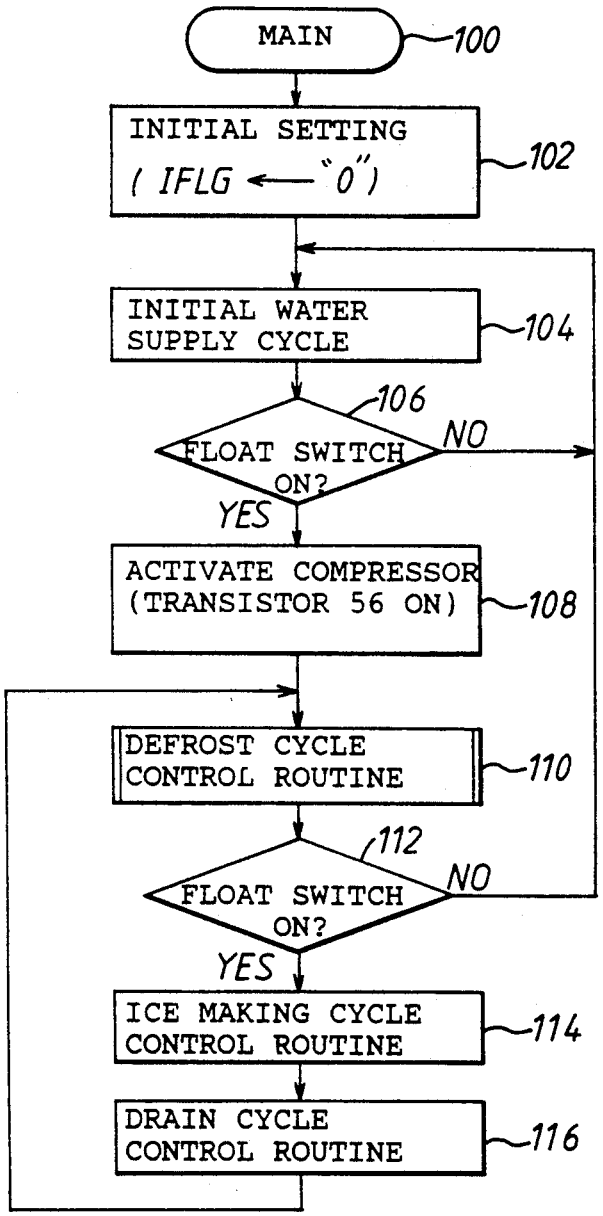
FIG. 3 is a flow chart of a main control program executed by a microcomputer shown in FIG. 2.
Figure 4:
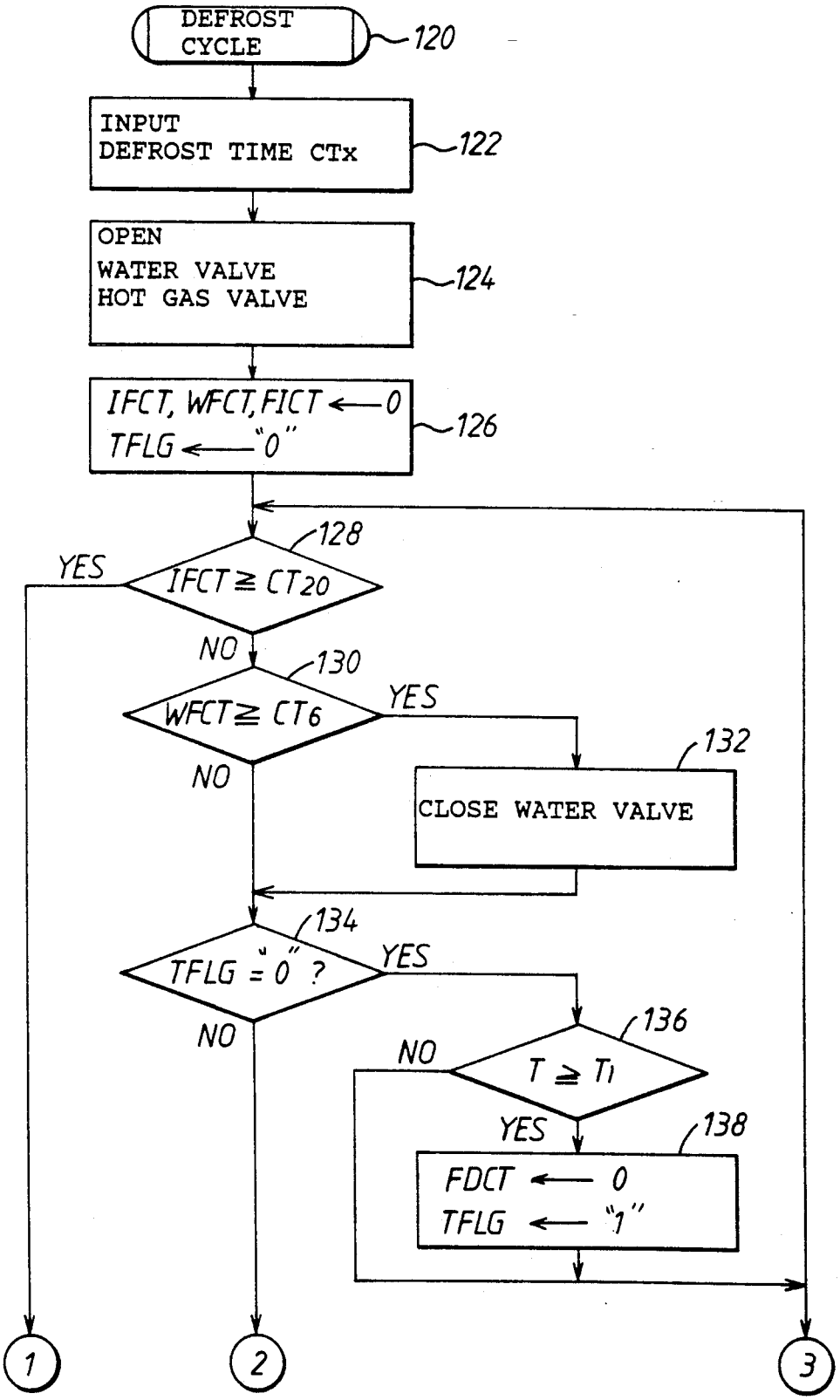
FIG. 4 and 5 is a flow chart of a defrost cycle control routine shown in FIG. 3.

After processing of the interruption program, the computer 40 executes the main control program at step 110 to 116 shown in FIG. 3. Assuming that the main control program has been returned to step 110, the computer 40 initiates execution of the defrost cycle control routine at step 120 shown in FIG. 4. At step 122, the computer 40 inputs a time value set by the defrost time setting switch 72 and sets the value as a defrost time value CTx. At the following step 124, the computer 40 causes the switching transistors 58, 64 to turn on respectively for energization of the relay coils 57*b*, 63*b*. Thus, the normally open contact 63*a* of relay switch 63 is closed in response to energization of the relay coil 63*b* to energize the solenoid 23*a* of water valve 23, and the movable contact 57*a* of relay switch 57 is switched over in response to energization of the relay coil 57*b* to energize the solenoid 18*a* of hot gas valve 18. As a result, the water valve 23 is opened to supply fresh water into the watering pipe 21 from the water service pipe 22, while the hot gas valve 18 is opened to permit the supply of compressed hot gas into the evaporator coil 13 from the compressor 14. When the program proceeds to step 126, the computer 40 resets the count values IFCT, WFCT, FICT to "0" and sets the temperature detection flag TFLG for temperature detection as "0". Thus, the count values IFCT, WFCT, FICT are counted up by "1" at each execution of the interruption program.

After processing at step 126, the computer 40 executes the defrost cycle control routine at step 128 to 150 to release the ice cubes from the front surface 12*a* of ice making plate 12 and to supply ice making water into the water tank 11. Immediately after operation of the power source switch, however, any ice cubes may not be formed on the ice making plate 12. For this reason, the release of the ice cubes will be described later. After processing at 128 to 144, the computer 40 determines at step 146 whether the initial flag IFLG is "0" or not. In this instance, the initial flag IFLG is previously set as "0" at step 102 in FIG. 3. At step 146, the computer 40 determines a "Yes" answer and causes the program to proceed to step 148. At step 148, the computer 40 determines whether the fourth count value FICT is more than or equal to a first predetermined value CT2 (for instance, a count value corresponding with 2 minutes) or not. If the fourth count value FICT is less than the first predetermined value CT2, the computer 40 determines a "NO" answer at step 148 and returns the program to step 128. When the fourth count value FICT becomes more than or equal to the first predetermined value CT2, the computer 40 determines a "YES" answer at step 148 and causes the switching transistors 64, 58 to turn off at step 152. Thus, the normally open contact 63*a* of relay switch 63 is opened to deenergize the solenoid 23*a* of water valve 23, while the movable contact 57*a* of relay switch 57 is switched over to deenergize the solenoid 18*a* of hot gas valve 18. As a result, the water valve 23 is closed to interrupt the supply of water into the watering pipe 21, and the hot gas valve 18 is closed to interrupt the supply of hot gas into the evaporator coil 13. After processing at step 152, the computer 40 changes the initial flag IFLG into "1", and finishes the defrost cycle control routine at step 156. Hereinafter, the initial flag IFLG will be maintained in "1", until the power source switch is turned on again.

When the program proceeds to step 112 shown in FIG. 3 after execution of the defrost cycle control routine, the computer 40 determines whether the float switch 34 is closed or not. If the level of water in tank 11 is below the predetermined level, the computer 40 determines a "No" answer at step 112 and returns the program to step 104 for the initial water supply cycle. When the float switch 34 is closed by increase of the water in tank 11, the computer 40 determines a "Yes" answer at step 112 and causes the program to step 114 for execution of the ice making cycle control routine. During execution of the ice making cycle control routine, the computer 40 maintains the switching transistor 56 conductive and maintains the switching transistors 58, 62 non-conductive to activate the electric motor 15*a* of cooling fan 15 under control of the relay switches 55, 57 and to effect forward rotation of the electric motor 25*a* of water pump 25 under control of the relay switches 55, 57 and 61. Thus, the watering pipe 24 is supplied with the ice making water from the water tank 11 through the water supply pipe 26 under forward rotation of the pump 25 and causes the supplied ice making water to flow down along the front surface 12*a* of ice making plate 12. In this instance, the hot gas valve 18 is closed under control of the relay switch 57, and the electric motor 14*a* of compressor 14 is activated under control of the relay switch 55. Thus, the evaporator coil 13 is supplied with expanded refrigerant from the expansion valve 17 under operation of the compressor 14 to freeze the water flowing down along the front surface 12*a* of ice making plate 12. When the water flowing down along the front surface 12*a* of ice making plate 12 is progressively frozen by the evaporator coil 13 into ice cubes A, the level of water in tank 11 will gradually lower to the predetermined level at which the float switch 34 is opened. When the float switch 34 is opened, the computer 40 turns on the switching transistor 58 to deactivate the electric motors 15*a* and 25*a* under control of the relay switches 57 and 61. Thus, the cooling fan 15 and water pump 25 are stopped to end the ice making cycle.

After execution of the ice making cycle control routine, the computer 40 executes the drain cycle control routine at step 116. During execution of the drain cycle control routine, the computer 40 maintains the switching transistor 58 conductive. Upon lapse of a predetermined short time (for instance, 2 seconds) from the beginning of execution of the drain cycle control routine, the computer 40 turns on the switching transistor 62 for a predetermined time (for instance, 10–20 seconds) to effect reverse rotation of the electric motor 25*a* under control of the relay switches 55, 61. Thus, the reverse rotation of water pump 25 is maintained for the predetermined time to effect the flow of ice making water into the discharge pipe 27 from the water tank 11. As a result, the pressure valve 28 is opened to discharge the ice making water therethrough from the water tank 11 into the overflow pipe 31 for eliminating contaminants in the water tank 11. In this instance, a portion of the ice making water is supplied into the sub-tank 33 through pipe 32 for washing the float switch 34.

When the main control program returns to step 110, the computer 40 executes the defrost cycle control routine again. In this instance, the computer 40 sets the defrost time value CTx at step 122 and executes processing at step 124 to open the water valve 23 for supplying fresh water from the water service pipe 22 into the watering pipe 21 and to open the hot gas valve 18 for supplying hot gas into the evaporator coil 13. At the following step 126, the computer 40 resets the first, second and fourth count values IFCT, WFCT and FICT to "0" and sets the temperature detection flag TFLG to "0". Thus, the upright ice making plate 12 is supplied with the fresh water from the watering pipe 21 and warmed by the hot gas supplied into the evaporator coil 13 to release the frozen ice cubes A therefrom. Simultaneously, the first, second and fourth count values IFCT, WFCT and FICT are counted up from "0".

After processing at step 122-126, the computer 40 determines at step 128 whether the first count value IFCT for ensuring the end of defrost cycle is more than or equal to a second predetermined value CT20 (for instance, a count value corresponding with 20 minutes), and determines at step 130 whether the second count value WFCT for detecting the ending time of water supply cycle is more than or equal to a third predetermined value CT6 (for instance, a count value corresponding with 6 minutes). Under usual circumstance, the computer 40 determines "No" answers at both steps 128, 130 and causes the program to proceed to step 134, since the count values IFCT, WFCT do not reach the predetermined value CT20, CT6.

At step 134, the computer 40 determines whether the temperature detection flag TFLG is "0" or not. In this instance, the temperature detection flag TFLG is previously reset at step 126. Thus, the computer 40 determines a "Yes" answer at step 134 and causes the program to proceed to step 136. At step 136, the computer 40 determines whether or not a refrigerant temperature T detected by the thermal sensor 44 is higher than or equal to a first predetermined temperature T1. In this embodiment, the first predetermined temperature T1 is defined to correspond with a temperature (for instance, 9 degrees centigrade) at which the frozen ice cubes A start to be released from the ice making plate 12 during the defrost cycle. In other words, the first predetermined temperature T1 is defined to be slightly lower than a temperature at which the refrigerant temperature detected by the thermal sensor 44 is saturated. When the temperature of ice making plate 12 and evaporator coil 13 is still lower than the first predetermined temperature T1 at the initial stage of the defrost cycle, the computer 40 determines a "No" answer at step 136 and returns the program to step 128 to repeat processing at step 128, 130, 134, 136 during which the water valve 23 is maintained in its open position to continue the supply of fresh water into the water tank 11 through the rear surface **12*b* of ice making plate 12. The hot gas valve 18 is also maintained in its open position to continue the supply of hot gas into the evaporator coil 13. Thus, the ice making plate 12 is warmed by the fresh water and hot gas applied thereto, and the temperature of ice making plate 12 gradually rises. Due to the temperature rise of ice making plate 12, the frozen ice cubes A start to be released from the ice making plate 12. When the temperature at the outlet portion of evaporator coil 13 becomes equal to or higher than the first predetermined temperature T1, the computer 40 determines a "Yes" answer at step 136 and causes the program to proceed to step 138. At step 138, the computer 40 resets the third count value FDCT to "0" and changes the temperature detection flag TFLG to "1". Thereafter, the program is returned to step 128**, and the third count value FDCT is counted up by execution of the interruption program.

Figure 5:
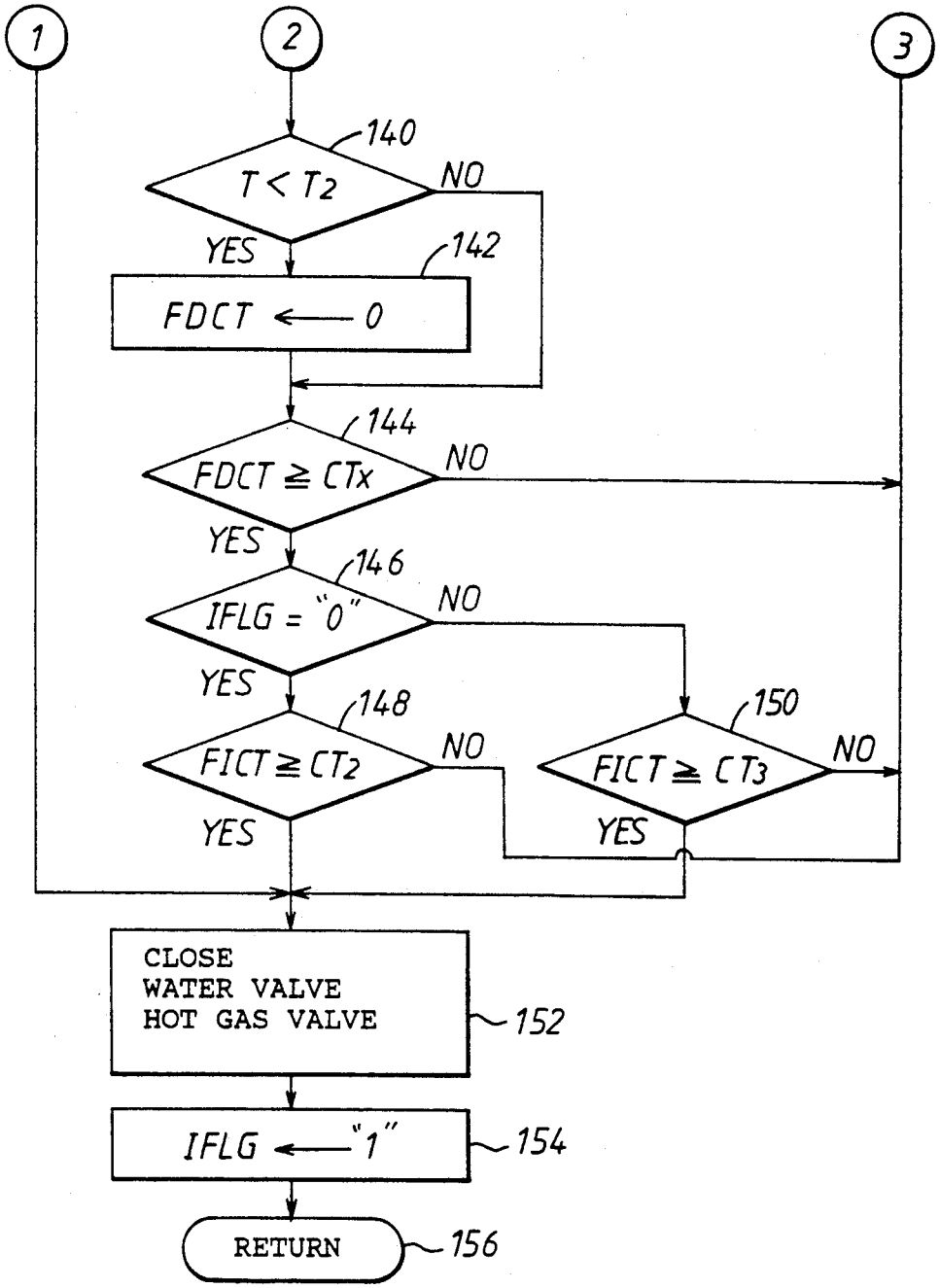

After processing of step 128, 130, the computer 40 determines a "NO" answer at step 134 to cause the program to proceed to step 140 shown in FIG. 5. At step 140, the computer 40 determines whether or not the refrigerant temperature detected by the thermal sensor 73 is lower than a second predetermined temperature T2 (for instance, 8 degrees centigrade) which is lower than the first predetermined temperature T1. Under usual circumstance, the computer 40 determines a "No" answer at step 140 and causes the program to proceed to step 144, since the refrigerant temperature detected by the thermal sensor 73 does not fall below the second predetermined temperature T2. At step 144, the computer 40 determines whether the third count value FDCT for detecting the ending time of defrost cycle is more than or equal to the defrost time value CTx set by the time setting switch 72. Upon lapse of a short time after the temperature detected by thermal sensor 73 became the first predetermined temperature T1, the computer 40 determines a "NO" answer at step 144 to cause the program to proceed to step 128 and to repeat processing at step 128, 130, 134, 140, 144.

When the third count value FDCT becomes more than or equal to the defrost time value CTx, the computer 40 determines a "YES" answer at step 144 to cause the program to proceed to step 146. At step 146, the computer 40 determines whether the initial flag IFLG is "0" or not. In this instance, the initial flag IFLG is previously set as "1" at step 154. Thus, the computer 40 determines a "NO" answer at step 146 to cause the program to proceed to step 150. At step 150, the computer 40 determines whether or not the fourth count value FICT for prohibiting the end of water supply cycle is more than or equal to a fourth predetermined value CT3. The fourth predetermined value CT3 is defined to correspond with a time ( for instance, 3 minutes) for ensuring the supply of fresh water to be used at the following lee making cycle. If the answer at step 150 is "Yes", the program proceeds to step 152, where the computer 40 closes the water valve 23 and hot gas valve 18, sets the initial flag IFLG as "1" at step 154 and finishes the defrost cycle control routine at step 156 in the same manner as described above. Thus, the frozen ice cubes A are completely released from the ice making plate 12 and received by the water plate 36 to be stored in the ice stocker 35.

As described above, the computer 40 ends the defrost control cycle routine, upon lapse of the defrost time value CTx after the temperature of the outlet portion of evaporator coil 13 detected by the thermal sensor 73 reached the first predetermined temperature T1. And the first predetermined temperature T1 is defined to be slightly lower than the saturated value of the temperature of the outlet portion of evaporator coil 13. Consequently, there is a small difference between the temperature detected by the thermal sensor 73 and presence of the ice cubes on the ice making plate 12, even if the temperature of the outlet portion of evaporator coil 13 saturates. Thereafter, the presence of the ice cubes on the ice making plate is accurately detected upon lapse of the defrost time value CTx. As a result, the defrost cycle of operation is ended without a waste of time when the ice cubes are completely released from the ice making plate 12. Additionally, the defrost time value CTx is selectively set in accordance with the condition where the ice making machine is installed. Consequently, the defrost cycle of operation is accurately ended irrespective of a difference in heat transfer coefficient between the ice making plate 12 and the evaporator coil 13 because of a difference in soldering and the changes of an ambient temperature and a defrost water temperature caused by change of the season and region.

On the other hand, even if the third count value FDCT for detecting the ending time of defrost cycle becomes more than or equal to the defrost time value CTx, the computer 40 determines a "No" answer at step 150 and returns the program to step 128 if the fourth count value FICT for prohibiting the end of water supply cycle is less than the fourth predetermined value CT3. Then, the computer 40 repeats processing at step 128, 130, 134, 140, 146, 150, where the water valve 23 is maintained in its open position to continue the supply of fresh water into the water tank 11. When the fourth count value FICT becomes more than or equal to the fourth predetermined value CT3 by execution of the interruption program, the computer 40 determines a "Yes" answer at step 150 and causes the program to proceed to step 152. Thereafter, the computer 40 finishes the defrost control cycle routine at step 156 after processing of step 152, 154. Thus, the supply of fresh water into the water tank 11 is continued at least for the fourth predetermined time CT3 even after the ice cubes A were released from the ice making plate 12. This is useful to ensure the supply of fresh water to be used at the following ice making cycle. In this embodiment, the fourth predetermined time CT3 is defined as 3 minutes which is longer than the first predetermined time CT2 defined as 2 minutes, because the processing of step 104 is not executed and the fresh water is not initially supplied into the water tank 11 under a condition where the initial flag IFLG is set as "1".

In turn, under a condition where the temperature of the fresh water supplied through the water valve 23 and the ambient temperature are extremely low, the ice cubes A are not completely released from the ice making plate 12 for a long time. In this instance, the temperature of the outlet portion of evaporator coil 13 detected by the thermal sensor 73 falls from the first predetermined temperature T1 to the second predetermined temperature T2 because of the extremely cold fresh water, ambient air and refrigerant which leaks from the refrigeration circuit. Thus, in this embodiment, the computer 40 determines a "Yes" answer at step 140 to cause the program to proceed step 142. At step 142, the computer 40 resets the third count value FDCT for detecting the ending time of defrost cycle to "0" to newly start counting up the third count value FDCT from "0". Consequently, the ice cubes A are completely released from the ice making plate 12, because the ending time of defrost cycle is postponed.

Under a condition where the fresh water supplied to the rear surface **12*b* of ice making plate 12 through the water service pipe 22 is extremely low, the fresh water may prevent the temperature of the ice making plate 12 and the evaporator coil 13 from rising during the defrost cycle. In this instance, the ice cubes A are not released from the ice making plate 12, even if the fresh water is supplied to the ice making plate 12 for a long time. Thus, in this embodiment, the temperature T of the outlet portion of evaporator coil 13 detected by the thermal sensor 73 is maintained less than the first predetermined temperature T1, and the computer 40 determines a "No" answer at step 136 to return the program to step 128 and repeats processing of step 128, 130, 134 and 136 for a long time, where the second count value WFCT for detecting the ending time of water supply cycle is gradually counted up by execution of the interruption program. When the second count value WFCT becomes more than or equal to the third predetermined value CT6, the computer 40 determines a "Yes" answer at step 130 to cause the program to step 132. At step 132, the computer 40 turns off the switching transistor 64. Thus, the normally open contact 63*a* of relay switch 63 is opened to deenergizing the solenoid 23*a* of water valve 23. As a result, the water valve 23 is closed to interrupt the supply of fresh water to the rear surface 12*b* of ice making plate 12 through the water service pipe 22. In turn, the hot gas valve 18 is maintained in its open position to continue the supply of hot gas into the evaporator coil 13. Thus, the ice making plate 12 and the evaporator coil 13 are warmed by the hot gas supplied to the evaporator coil 13 and their temperature rise. Consequently, the ice cubes A are completely released from the ice making plate 12, even if the water supplied to the ice making plate 12 through the water service pipe 22 is extremely low. This is also useful to avoid useless discharge of the ice making water from the water tank 11**.

Under a condition where the ambient temperature is extremely low, the temperature of the outlet of evaporator coil 13 may be maintained less than the first predetermined value T1 even after the ice cubes A were completely released from the ice making plate 12. In this instance, the defrost cycle continues for a long time. In this embodiment, computer 40 determines a "No" answer at step 136 to return the program to step 128 even after stopping the water supply. Thus, the computer 40 repeats processing of step 128–136 for a long time, where the first count value IFCT for ensuring the end of defrost cycle is gradually counted up by execution of the interruption program. When the first count value IFCT becomes more than or equal to the second predetermined value CT20, the computer 40 determines a "Yes" answer at step 128 to cause the program to proceed to step 152. After processing of step 152, 154, the computer 40 finishes the defrost cycle control routine at step 156 as describe above. This is useful to avoid continuing the defrost cycle control routine for a long time.

Although in the above embodiment the third count value FDCT for detecting the ending time of defrost cycle is reset to the initial value of "0" when the temperature of the outlet portion of evaporator coil 13 detected by the thermal sensor 73 falls from the first predetermined value T1 to the second predetermined value T2, this initial value may be other value, for example a value which is slightly larger than "0". Although in the above embodiment the first and second predetermine values T1, T2 are constant, these temperature T1, T2 may be variables selected by user like the defrost time value CTx.

What is claimed is:

1. An electric control apparatus for an ice making machine having a water tank arranged to store an amount of ice making water, an upright ice making plate arranged above said water tank, an evaporator attached to a rear surface of said ice making plate, a refrigeration circuit for circulating refrigerant into said evaporator through a compressor, a condenser and an expansion valve, a normally closed hot gas valve disposed within a bypass line of said refrigeration circuit to be opened at a defrost cycle for supplying hot gas from said compressor into said evaporator, a normally closed water valve arranged to be opened at the defrost cycle for supplying fresh water from an external source of water to an upper portion of the rear surface of said ice making plate, and a water pump arranged to be activated at an ice making cycle for supplying the ice making water from said water tank to an upper portion of a front surface of said ice making plate, the electric control apparatus comprising:

first control means for activating said water pump at the ice making cycle during which said compressor is activated in a condition where said hot gas valve and said water valve are maintained in their closed positions; and second control means for deactivating said water pump after a finish of the ice making cycle and opening said hot gas valve and said water valve at the defrost cycle in a condition where said compressor is maintained in its activated condition, said second control means including a thermal sensor arranged to detect a temperature at an outlet of said evaporator, first timer means for starting measurement of a first predetermined time when the detected temperature rises to a first predetermined temperature, means for closing said hot gas valve and said water valve upon lapse of the first predetermined time, means for determining whether the detected temperature is lower than a second predetermined temperature lower than the first predetermined temperature, said second control means also including second timer means for causing said first timer means to restart measurement of the first predetermined time when the detected temperature becomes lower than the second predetermined temperature during the defrost cycle.

2. An electric control apparatus as claimed in claim 1, wherein said second control means further comprises time setting means for selectively setting the first predetermined time in consideration with one of an ambient temperature of said ice making machine and a temperature of fresh water supplied from said external source of water.

3. An electric control apparatus as claimed in claim 1, wherein said second control means further comprises third timer means for starting measurement of a second predetermined time from a start of the defrost cycle, the second predetermined time being defined to supply fresh water into said water tank to supplement the water consumed at the ice making cycle, and means for maintaining said hot gas valve and said water valve in their open positions during the second predetermined time and for closing said hot gas valve and said water valve upon lapse of the second predetermined time.

4. An electric control apparatus as claimed in claim 3, wherein said second control means further comprises fourth timer means for starting measurement of a third predetermined time from a start of the defrost cycle, the third predetermined time being defined to be longer than the second predetermined time, and means for closing said water valve upon lapse of the third predetermined time when the detected temperature does not rise to the first predetermined temperature at the defrost cycle.

* * * * *